United States Patent [19]

Davies et al.

[11] Patent Number: 4,681,668

[45] Date of Patent: Jul. 21, 1987

[54] ANODIC ALUMINIUM OXIDE FILM AND METHOD OF FORMING IT

[75] Inventors: Nigel C. Davies; Peter G. Sheasby, both of Banbury, England

[73] Assignee: Alcan International Limited, Montreal, Canada

[21] Appl. No.: 793,742

[22] Filed: Oct. 31, 1985

[30] Foreign Application Priority Data

Nov. 5, 1984 [GB] United Kingdom ..... 8427943

[51] Int. Cl.[4] ..... C25D 11/08

[52] U.S. Cl. ..... 204/28

[58] Field of Search ..... 204/28, 38.3, 38.7

[56] References Cited

U.S. PATENT DOCUMENTS

| | | | |
|---|---|---|---|
| 3,909,387 | 9/1975 | Kolic | 204/28 |
| 4,196,060 | 4/1980 | Patrie | 204/28 |
| 4,566,952 | 1/1986 | Sprintschnik | 204/28 |

*Primary Examiner*—T. M. Tufariello

*Attorney, Agent, or Firm*—Cooper, Dunham, Griffin & Moran

[57] ABSTRACT

An anodic oxide film is formed on aluminium strip by continuously passing the strip through a phosphoric acid electrolyte at from 25° C. to 80° C., the contact time between the strip and the electrolyte being not more than 15 seconds during which time the strip is anodized at a current density of at least 250 A/m$^2$. In the resulting film, the pores are enlarged so that the effected surface area is increased. The film forms an excellent substrate for lacquer, paint, or adhesive.

11 Claims, 5 Drawing Figures

ANODIC ALUMINIUM OXIDE FILM AND METHOD OF FORMING IT

This invention is concerned with the preparation of aluminium surfaces for application of organic coatings by continuously anodizing aluminium strip in a phosphoric acid based electrolyte under controlled conditions. These conditions enable anodic oxide film structures with very high surface area to be produced, the result depending on the balance between film growth and film re-dissolution in the acid electrolyte. Such films form an ideal surface preparation for application of lacquers or paints for example in the canning and packaging or the architectural industries, or for adhesive bonding in the production of aluminium based structures.

Many other workers have used anodizing processes as a pretreatment before application of an organic coating. For example Alcan British Pat. No. 1,235,631 describes the use of short AC anodizing treatments in hot sulphuric acid as a pretreatment for lacquering for aluminium used for example in canning applications. Whilst this treatment (which is in wide commercial use) gives good lacquer adhesion under some conditions, with critical lacquers or in critical applications it is sometimes inadequate. The present invention using a phosphoric acid based electrolyte surprisingly overcomes these problems.

Another benefit of anodizing in a phosphoric acid based electrolyte is that the film structure contains significant amounts of phosphate, rather than sulphate in the case of a sulphuric acid electrolyte. Phosphate is known to be a hydration inhibitor with oxide surfaces, and as deterioration of the pretreated surface often occurs through hydration of the oxide, at least at its surface, the presence of a hydration inhibitor at this point is beneficial.

Phosphoric acid anodizing has been used as a preparation for adhesive bonding in the aircraft industry, particularly by Boeing (British Pat. No. 1,555,940), and this form of pretreatment is considered to be one of the best available for long-term durability in structural applications. This durability is thought to depend on the type of structure produced by phosphoric acid anodizing under the Boeing conditions described and many papers have been written on this subject (e.g. J. D. Venables et al, Appl. Surface Science 3, 1979, 88–98). However the Boeing process requires an anodizing time of 5–60 minutes in a phosphoric acid electrolyte at a temperature of 10°–30° C. In practice an anodizing time of 20–30 minutes is usually used, and clearly this is only suitable for batch treatment of components rather than as a continuous treatment for aluminium coil. Although film thicknesses are not reported in the patent examples, in practice a minimum thickness of 300–400 nm appears necessary to achieve the desired properties.

Films produced by the Boeing process have excellent properties as adhesive substrates, to the extent that they constitute a standard to which the rest of the industry aspires. The method of this invention is capable of rapidly and continuously producing anodic oxide films which, though thinner than the Boeing films, give rise to adhesive bonds of equivalent durability.

An article in Research Disclosure, April 1975 page 29, describes an anodizing treatment of aluminium in phosphoric acid as a basis for elastomer coatings. Although wide ranges are given, preferred conditions are 5% phosphoric acid at 49° C. and 400–500 A/m$^2$ for one minute. Similarly, French Patent Specification No. 2382330 describes a continuous anodizing treatment of aluminium in phosphoric acid as a basis for adhesives. Again, although wide ranges are given, preferred conditions are 30% phosphoric acid at 5 V for 30 seconds. Neither reference describes useable conditions that would be effective for continuously treating aluminium strip at the speed required in a production line.

Other uses of phosphoric acid anodizing have been as a preparation for application of light sensitive coatings in the lithographic printing industry (British Pat. No. 1,244,723). Again the process requires anodizing times of 2–20 minutes at current densities of not more than 200A/m$^2$ and at temperatures, preferably below 30° C., sufficiently low to avoid significant dissolution of the oxide film. In the same field a mixture of sulphuric acid (25–150 g/L) and phosphoric acid 10–50 g/L) has been used for anodizing at current densities of 400–2500A/m$^2$ at temperatures of 25°–65° C. (U.S. Pat. No. 4,299,266).

The present invention provides a method of forming an anodic oxide film on an aluminium strip by continuously passing the strip through a phosphoric-acid-containing electrolyte maintained at a temperature of from 25° to 80° C., the contact time between the strip and the electrolyte being not more than 15 seconds during which time the strip is anodized at a current density of at least 250 A/m$^2$.

Although the nature of the aluminium strip is not critical, it will generally be a sheet or coil. To provide a continuous strip, the tail of one coil may be joined to the head of the next. Since the method is designed to be operated continuously, it needs to be compatible with existing and future plant for treating continuous strip. Such plant generally has a line speed of at least 50 m/min, often 150–250 m/min. To avoid the need for very long treatment baths, short electrolyte contact times are needed. An electrolyte contact time of 15 s is the longest that is likely to be practicable. Electrolyte contact times of no more than 10 s, e.g. 1 to 6 s, preferably 2 to 3 s, are likely to be more convenient, and times as short as 0.5 s are possible. The electrolyte contact time at any particular line speed may be regarded as a fixed feature of the plant, and one about which the other process variables are adjusted.

The present invention relies on achieving a satisfactory balance between anodic film formation and dissolution of the film in the phosphoric acid electrolyte. Sufficient anodic film must be grown to give adequate structural strength to the film and to provide an adequate surface area to give improved adhesion. Equally dissolution of the film must take place so that the original pore structure is enlarged. However, this attack must not be sufficient to cause breakdown and powdering of the film. With an acid such as phosphoric acid which is capable of strongly attacking the anodic film such a balance is difficult to achieve, particularly when anodizing at high speeds on continuous treatment lines.

Film growth is essentially controlled by the anodizing current density used. Film growth per unit time is substantially proportional to anodizing current density. With the short contact times available, current density needs to be high to achieve a sufficiently thick film. The current density is specified as being at least 250 A/m$^2$ and may be as high as can be achieved by the equipment used, e.g. up to 2000 A/m$^2$ or even more. Preferred current densities are likely to lie in the range of 300–1500 A/m$^2$.

It will be convenient to relate current density with electrolyte contact time in order to achieve a desired film thickness. This may be expressed by saying that the total anodizing input will usually be in the range 1.103 to 12.103, particularly 2.10$^3$ to 6.10$^3$, C/m$^2$.

We define current density and coulombic input as follows:

a.c.

$$\text{Current Density} = \frac{\text{a.c. meter reading}}{\text{total surface area}} \ (\text{Amps/m}^2)$$

$$\text{Effective a.c. coulombic input} = \frac{\text{a.c. meter reading}}{\text{total surface area}} \times \frac{\text{time}}{2} \ (\text{Coulombs/m}^2)$$

d.c.

$$\text{Current Density} = \frac{\text{d.c. meter reading}}{\text{total surface area}} \ (\text{Amps/m}^2)$$

$$\text{Coulombic input} = \frac{\text{d.c. meter reading}}{\text{total surface area}} \times \text{time} \ (\text{Coulombs/m}^2)$$

That is, the effective a.c. coulombic input considers the time in the anodic half cycle only.

Film attack is essentially controlled by the nature, concentration, and temperature of the electrolyte, with temperatures being the most important factor. In considering the nature of this attack, it needs to be borne in mind that an anodic oxide film is created at the metal-/oxide interface, i.e. at the inner surface of the oxide film remote from the electrolyte. Chemical dissolution occurs at the outer surface of the film, and it is thus the oldest remaining film that is subject to attack. Anodic oxide film formed in phosphoric acid is necessarily porous, and chemical dissolution is concentrated in the pores and has the effect of enlarging the pores and so increasing the effective surface area of the film.

The temperature of the electrolyte in the method of this invention is specified as 25° C. to 80° C. and this range is critical. If the electrolyte temperature is too low, then no significant chemical dissolution takes place during the (limited) electrolyte contact time and the surface area is not increased. If the electrolyte temperature is too high, then chemical dissolution may outpace film growth to the extent that all film is redissolved as fast as it is formed. Thus with a phosphoric acid solution at 90° C., it proved impossible to generate anodic oxide film even at a current density of 1250 A/m$^2$. When AC anodizing is employed (as is preferred, see below), the optimum electrolyte temperature is likely to be in the range 30° to 70° C. With DC anodizing, somewhat higher temperatures up to 80° C. may be useful.

Electrolyte concentration has a much less marked effect on the rate of chemical dissolution of the film. Phosphoric acid concentrations in the range 5–15% by weight have been found suitable, but more or less concentrated solutions could be used. There may also be present in the electrolyte one or more other acids known to be capable of generating porous anodic oxide films, for example oxalic acid or sulphuric acid. Such other acids should preferably be present, if at all, only in minor proportions amounting to not more than 50% of the weight of the phosphoric acid.

The aluminium strip may consist of pure aluminium but is more likely to be of an alloy, for example in the 2000, or 3000, or 5000, or 6000 Series of the Aluminum Association Inc., Register. The nature of the alloy is not critical but may affect the anodizing conditions. Thus Mg-rich alloys of the 5000 series form an oxide film containing MgO that is rather soluble in the electrolyte so that a lower electrolyte temperature may be chosen.

The anodizing electric current is preferably AC so that the aluminium strip is alternately anodically polarized (during which time film growth predominates) and cathodically polarized (during which time chemical dissolution of the oxide film predominates). Biased AC wave forms may be employed with advantage to achieve the desired balance between film growth and chemical dissolution. The AC frequency may be greater or (more likely) less than the standard 50 c/s. Alternatively DC may be employed, either continuously or as a pulsed current to increase the extent of chemical dissolution (between the pulses) relative to film growth.

Equipment for continuous anodizing of aluminium strip is well known, and is described for example in "Automation in Anodizing" by W. E. Cooke (Aluminum Association, Aluminum Finishing Symposium, Chicago, March 1973). Suitable equipment includes an elongated bath with inlet and outlet ports for electrolyte and with opposed end faces having seals if necessary through which the continuous aluminium strip passes, the arrangement being such that the electrolyte preferably flows countercurrent to the strip. Two or more electrodes are positioned adjacent or indeed surrounding the moving strip, the electrodes being spaced in the direction of travel of the strip. Current leakage through the electrolyte is low because the electrolyte has a much lower conductivity than the metal.

The voltage is determined by the value of current density at which one has chosen to operate. Hence it finds its own level according to the current density and temperature (it is quite markedly effected by temperature at constant current density). For example at the lower end of the temperature range, 35° C., we have measured the voltage at about 40 V for 600 A/m$^2$. The voltage is reduced as the temperature goes up. However, having determined suitable anodizing conditions it may be convenient to operate under those conditions by controlling the voltage (as well as the electrolyte temperature.) Preferred voltages are generally in the range 10–45 V, particularly 15–35 V.

Because the film is readily attacked by the hot phosphoric acid electrolyte, rapid rinsing of the film surface is required after anodizing, and this is readily achieved in a continuous coil process.

The result of this method is a continuous aluminium strip carrying a porous anodic oxide film which contains phosphate ion, the pores of which are enlarged so that the effective surface area of the film is increased. The film is generally 15 to 200 nm thick; below 15 nm controlled chemical dissolution is difficult to achieve, and it is difficult to effect more than 200 nm of film growth in an electrolyte contact time of no more than 15 s.

Anodizing in suitable acids results in porous anodic oxide films which may be regarded as consisting of an array of hexagonal cells with a pore in the centre of each cell. The diameter and spacing of the pores depends on the anodizing voltage; when this is X V, the pore diameter is typically X nm and the pore spacing 2.5X nm. In the particular case of phosphoric acid, the pores are frequently larger than X nm due to chemical dissolution during anodizing. Surrounding each pore is a region of gelatinous aluminium oxide material and this is where the phosphate ion content chiefly arises. The cell boundaries surrounding the gelatinous material, and particularly the triple points, are composed mainly of alpha-alumina.

It is believed that film attack by electrolyte involves mainly solution of the gelatinous material resulting in enlargement of the pores at their outer ends and an increase in the effective surface area of this film. Further attack may dissolve the cell walls so that the enlarged pores become interconnected at least at their outer ends with pillars of mainly alpha-alumina remaining at the triple points of the cell boundaries. Eventually chemical dissolution proceeds so far that the film becomes friable, and in this state it is no longer suitable as a substrate for organic coatings. The method of this invention aims to achieve a controlled amount of dissolution. In the resulting strip, the pores are enlarged to such an extent that they are partly interconnected at least at their outer ends. The density of the porous region of the film (excluding the barrier layer) is rather low; although this effect may be marked in measurements of overall film density by the fact that the thickness of the barrier layer relative to total film thickness is necessarily substantial. The ratio of pore volume to cell volume is rather high, typically 0.25 to 0.6.

This continuous aluminium strip may be cut and shaped as desired. The anodic oxide film forms an excellent substrate for a variety of functional or protective organic coatings. Paint can be applied, e.g. for architectural or vehicle or other use; lacquer can be applied for canning applications or for foil conversion; light sensitive resins can be applied for lithographic use; adhesives can be applied in order to form adhesively bonded structures.

In the accompanying drawings:

FIG. 1 is a microphotograph ($10^5$ magnification) showing the typical structure of an anodic oxide film produced by continuous AC anodizing in hot sulphuric acid according to British Patent Specification No. 1235631. The porous nature of the anodic film can clearly be seen, but the film surface is relatively little attacked. Conditions were:

| | |
|---|---|
| Alloy | 3103 |
| Contact time | 3 s |
| Temperature | 90° C. |
| Current density | 1100 A/m$^2$ |
| Bath | 20% $H_2SO_4$. |

FIG. 2 is a microphotograph ($5\times10^4$ magnification) showing a general view of a surface prepared by AC anodizing according to this invention. Conditions were:

| | |
|---|---|
| Alloy | 1050 |
| Contact time | 10 s |
| Temperature | 45° C. |
| Current density | 600 A/m$^2$ |
| Bath | 10% $H_3PO_4$. |

| | |
|---|---|
| Alloy | 1050 |
| Contact time | 10 s |
| Temperature | 62° C. |
| Current density | 300 A/m$^2$ |
| Bath | 10% $H_3PO_4$. |

Figure 5:
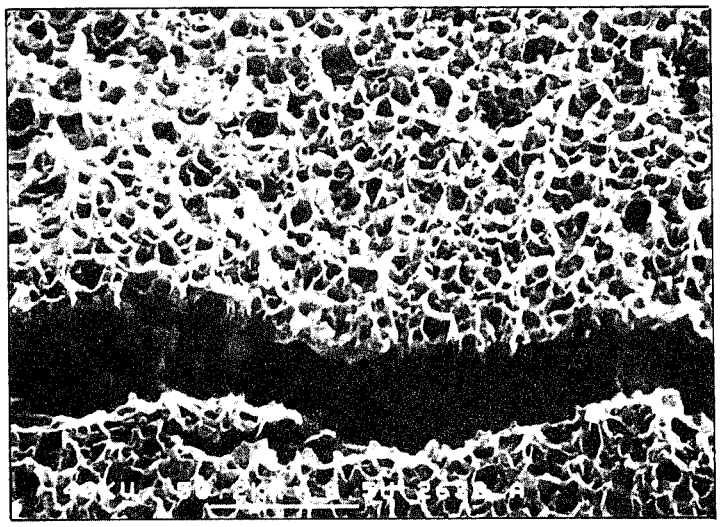

FIG. 5 is a high resolution SEM micrograph ($5\times10^4$ magnification) of the anodic film structure on a 5000 series alloy obtained by AC anodizing according to this invention. Conditions were:

| | |
|---|---|
| Alloy | 5251 |
| Contact time | 10 s |
| Temperature | 45° C. |
| Current density | 600 A/m$^2$ |
| Bath | 10% $H_3PO_4$. |

The following Examples illustrate the invention.

EXAMPLE 1

In order to demonstrate the structures formed by this process, 1050 alloy was taken and anodized in a 10% phosphoric acid solution at 45° C. for 10 seconds at a current density of 600 A/m$^2$. The sample was not degreased prior to AC anodizing and was rinsed immediately after the process in deionised water. The structure was examined using a high resolution scanning electron microscope. This was achieved by deliberately bending and cracking the sample and examining the fracture edge. In the accompanying micrographs wide, dark striations appear across the images; this is the alloy substrate revealed by the sample preparation.

Figure 2:
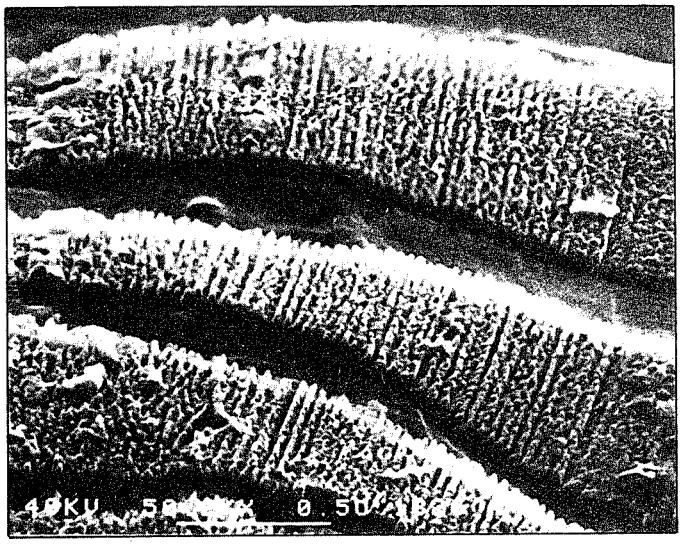
Figure 3:
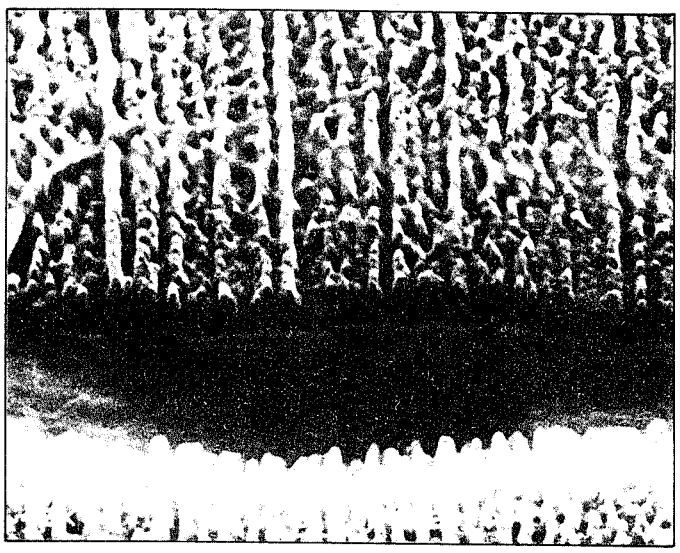
FIG. 3 is a high resolution SEM micrograph ($10^5$ magnification) of the anodic film structure shown in FIG. 2.

FIG. 2 shows the uniformity and density of the anodic film growth under the above conditions and FIG. 3 shows the open pore structure that has been generated. The barrier layer is 40 nm thick with the pore walls 75 nm high (i.e. maximum film thickness).

EXAMPLE 2

Figure 4:
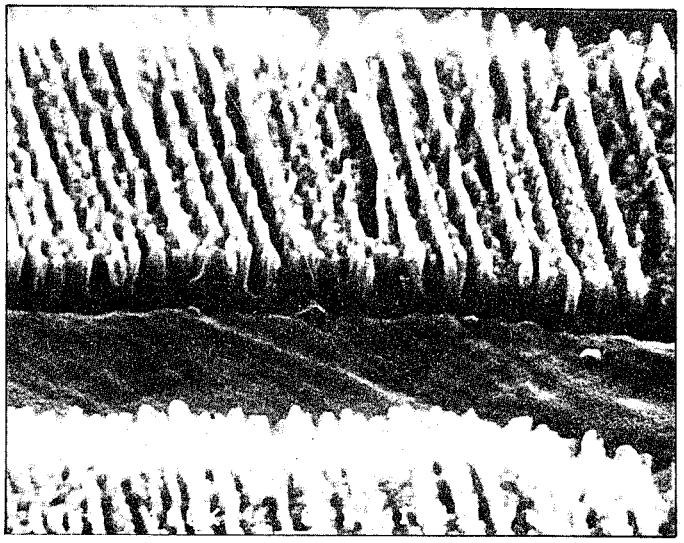
FIG. 4 is a high resolution SEM micrograph (105 magnification) of the anodic film structure obtained by AC anodizing according to this invention. Conditions were.

Increasing the bath temperature to 62° C. and using a lower current density of 300 A/m$^2$ results in the structure shown in FIG. 4. In this case the barrier layer is 30 nm with the pore walls extending to a total film thickness of 100 nm. Both of these surfaces indicate the competing reactions of film growth and film dissolution. A higher temperature with a lower current density will result in a thicker film with even finer pore wall structures than shown.

Figure 1:
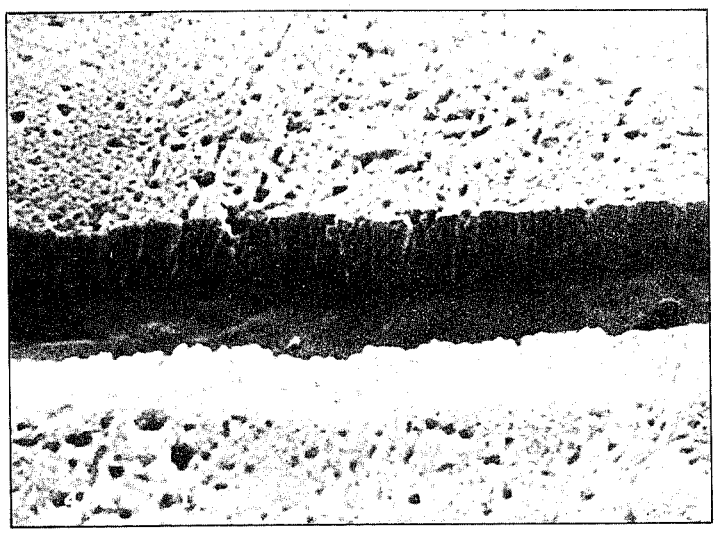

What is important is the high surface area available for adhesion as compared to the more dense film with fine pores produced with the conventional hot AC anodizing process in sulphuric acid (FIG. 1). The structures produced in this work are more akin to the adhesive bonding structure postulated in GB No. 1555940 but are thinner and can be prepared with very short pretreatment times.

EXAMPLE 3

To demonstrate the effect of varying the alloy, films were grown on a 5251 alloy. The experimental conditions were similar to Example 1 i.e. 10% (wt) phosphoric acid, 45° C., 600 A/m$^2$ with a pretreatment time of 10 seconds. The panels were rinsed immediately after pretreatment.

The structure obtained is shown in FIG. 5. Compared to the films grown on 1050 alloy, the anodic film is far more attacked with increased dissolution as a result of the magnesium content of this alloy. The micrographs indicate the wide range of structures that can be obtained with this process.

EXAMPLE 4

Panels of 5251 prepared under the above conditions were adhesively bonded in a lap-shear joint configuration using a toughened epoxy adhesive (Permabond ESP 105). The initial bond strength was measured and joints were exposed to a neutral salt spray at 43° C., for periods of 2, 4, and 8 weeks. At these intervals, samples were taken and the retention of initial bond strength monitored. As a control, material prepared as in British Patent Specification 1555940 was also bonded and tested. This was 5251 alloy, DC anodized at 12 V in 10% (wt) phosphoric acid solution for 30 minutes.

Initial bond strengths were identical; after the elapse of 8 weeks the retention of bond strength of the material prepared as described in this specification was 71.9% as compared to 70.1% for the DC prepared material. This demonstrates the potential performance of surfaces prepared by this novel method using extremely short pretreatment times.

EXAMPLE 5

Using a small continuous anodizing facility, a coil of AA 5052 was anodized at speeds up to 24 m/min using both alternating and direct current as power supplies. The effective length was 0.5 m with graphite as the counter electrode; the electrolyte was 10 wt % $H_3PO_4$ at 55° C.

Three sample coils were separately coated with two different types of epoxy-phenolic lacquer, a third with a polyester lacquer and a fourth with an organosol lacquer. Cans were drawn from each coil of material and pieces of the cans subjected to various tests. These included scratching the corners and treating in water at 120° C. in a autoclave for 1 hour; heating in 0.5% tartaric acid at 120° C.; heating for 1 hour in 2% lactic acid at 120° C.; boiling (100° C.) for 3, 8, or 16 hours in 5% acetic acid +2% tartaric acid. After testing the samples were examined for defects and mechanical degradation and alloted points according to the number of defects. The figures were "pooled" to provide a composite performance rating on a scale 0–64; the *lower* the score the better the performance. Results are set out in Table 1.

TABLE 1

Adhesion performance of continuously anodized AA 5052

| Mode of Current | Volts | Contact Time (secs) | Line Speed | Coulombic Input/m$^2$ | Adhesion Performance |
|---|---|---|---|---|---|
| a.c. | 30 | 5 | 6 | 3125 (a.c.) | 8 |
| d.c. | 34 | 5 | 6 | 4500 (d.c.) | 8 |
| d.c. | 34 | 2.5 | 12 | 2500 (d.c.) | 12 |
| d.c. | 34 | 1.25 | 24 | 1400 (d.c.) | 18.5 |

By comparison, a continous commercial a.c. coil process, in 20% sulphuric acid at 90° C. for 2.5 seconds at 1250 Amps/m$^2$, gave rise to a coil product having a lacquer adhesion performance of 33, considerably inferior to the performances achieved by the present invention.

EXAMPLE 6

This example compares the effect of different coatings as a basis for adhesive. AA 5251 alloy sheet was subjected to the following pretreatments:

1. A commercial chromate/phosphate conversion coating.
2. Hot a.c. phosphoric acid anodizing (600 A/m$^2$, 10 s, 45° C.) according to the invention.
3. Acid etch.
4. Pairs of specimens were stuck together using three different single part epoxy adhesives and two different two-part acrylic adhesives. The top adherend was peeled off at 90° C. at room temperature and 50 mm/min. The peel strengths (in Newtons) are set out in Table 2.

TABLE 2

| Adhesive | Peel Strengths (N) 1 A Chromate/ Phosphate Conversion Coating | 2 Hot A.C. Phosphoric Acid Anodized | 3 Acid Etched Surface |
|---|---|---|---|
| Single part epoxy A | 78 | 125 | 75 |
| Single part epoxy B | 73 | 100 | 84 |
| Single part epoxy C | 73 | 130 | 76 |
| Two part acrylic A | 80 | 135 | 87 |
| Two part acrylic B | 90 | 145 | 80 |

Pretreatment according to this invention gave much superior results. An additional advantage of the pretreatment according to the this invention over chromate conversion coatings is that toxicity and waste-disposal problems associated with chromates are eliminated.

EXAMPLE 7

AA 3005 was anodized for 10 seconds at 600 A/m$^2$ a.c. and 15 V in an electrolyte containing 10% by weight of $H_3PO_4$ and 2.5% by weight of $H_2SO_4$ at 55° C.

The resulting anodic oxide film had a total thickness of 60 nm including a barrier layer 20 nm thick, and a cell dimension variable in the range 10–20 nm. The open cell structure, coupled with the surface phospate, provides a good base for subsequently applied adhesive.

We claim:

1. A method of forming an anodic film on an aluminium strip by continuously passing the strip through a phosphoric-acid-containing electrolyte maintained at a temperature of from 25° to 80° C., the contact time between the strip and the electrolyte being not more than 15 seconds during which time the strip is anodized at the current density of at least 250 A/m$^2$, the nature, concentration and temperature of the elcectrolyte being chosen in relation to the current density such that the rate of chemical dissolution of the oxide film is comparable to, but less than, the rate of anodic oxide formation, whereby there is formed on the surface of the strip an anodic oxide film from 15 to 200 mm thick and containing phosphate ion.

2. A method as claimed in claim 1, wherein the anodizing is effected by means of AC.

3. A method as claimed in claim 2, wherein the electrolyte contains 5–15% by weight of phosphoric acid and is maintained at a temperature of from 30° to 70° C., the electrolyte contact time is from 0.5 to 15 s and the anodizing current density is from 250 to 2000 $A/m^2$.

4. A method as claimed in claim 3, wherein the anodizing voltage is from 15 to 35 V.

5. A method as claimed in claim 3, wherein the anodizing coulombic input is from 2000 to 6000 $C/m^2$.

6. Continuous aluminium strip and articles formed therefrom, wherein the strip carries a porous anodic oxide film on its surface which film is from 15 to 200 nm thick and contains phosphate ion, the pores being enlarged to such an extent that the effective surface area of the film is increased.

7. Continuous aluminium strip and articles formed therefrom as claimed in claim 6, wherein the ratio of pore volume to cell volume in the oxide film is from 0.25 to 0.6.

8. Continuous aluminium strip and articles formed therefrom as claimed in claim 6, wherein the pores of the film are enlarged to such an extent that they are partly interconnected at least at their outer ends.

9. Continuous aluminium strip and articles formed therefrom as claimed in claim 6, carrying an organic decorative or protective layer firmly bonded to the surface of the film.

10. Continuous aluminium strip and articles formed therefrom as claimed in claim 6, carrying an adhesive firmly and directly bonded to the film.

11. A structure of two or more shaped aluminium components adhesively bonded together, characterized in that at least one of the components carries a porous anodic oxide film on its surface which film is from 15 to 200 nm thick and contains phosphate ion, the pores being enlarged to such an extent that the effective surface area of the film is increased.

* * * * *